US006357654B1

(12) United States Patent
Gardner et al.

(10) Patent No.: US 6,357,654 B1
(45) Date of Patent: Mar. 19, 2002

(54) CORRUGATED PAPERBOARD CONTAINER CROSS-REFERENCE TO RELATED APPLICATION

(75) Inventors: Jeffrey M. Gardner, West Chicago; L. James Pacheco, North Aurora, both of IL (US)

(73) Assignee: Weyerhauser Company, Federal Way, WA (US)

( * ) Notice: Subject to any disclaimer, the term of this patent is extended or adjusted under 35 U.S.C. 154(b) by 0 days.

(21) Appl. No.: 09/847,817

(22) Filed: May 2, 2001

Related U.S. Application Data

(60) Provisional application No. 60/200,950, filed on May 1, 2000.

(51) Int. Cl.[7] ..... B65D 5/32; B65D 5/56

(52) U.S. Cl. ..... 229/122.32; 229/164; 229/919

(58) Field of Search ..... 229/122.32, 164, 229/919; 220/FOR 153, FOR 155

(56) References Cited

U.S. PATENT DOCUMENTS

| | | | | |
|---|---|---|---|---|
| 1,324,873 A | * | 12/1919 | Bovy | 229/122.32 |
| 1,372,809 A | | 3/1921 | Gross | |
| 1,974,527 A | | 9/1934 | Bliss | |
| 2,606,709 A | | 8/1952 | Carey et al. | |
| 2,939,620 A | * | 6/1960 | Royce | 229/122.32 |
| 2,984,402 A | | 5/1961 | Putnam | |
| 3,048,318 A | | 8/1962 | Sabin | |
| 3,099,379 A | | 7/1963 | Stease | |
| 3,214,076 A | | 10/1965 | Gagnon | |
| 3,348,667 A | | 10/1967 | Beeby | |
| 3,434,648 A | * | 3/1969 | Barry, Jr. | 229/122.32 |
| 3,905,541 A | | 9/1975 | Paxton | |
| 3,921,893 A | | 11/1975 | Randle, Jr. | |
| 3,993,239 A | | 11/1976 | Exel | |
| 4,120,443 A | | 10/1978 | Gardner et al. | |
| 4,127,304 A | | 11/1978 | Gardner | |
| 4,175,691 A | * | 11/1979 | Cornell et al. | 229/122.32 |
| 4,194,678 A | | 3/1980 | Jasper | |
| 4,197,789 A | | 4/1980 | Moen | |
| 4,220,076 A | | 9/1980 | Moen | |
| 4,282,999 A | | 8/1981 | Moen | |
| 4,283,188 A | | 8/1981 | Wingerter et al. | |
| 4,303,405 A | | 12/1981 | Reichert | |
| 4,310,323 A | | 1/1982 | Moen | |

(List continued on next page.)

FOREIGN PATENT DOCUMENTS

DE 3824930 A1 * 1/1990 ..... 229/164

OTHER PUBLICATIONS

U.S. application No. 09/797,997, filed Mar. 2, 2001, Jeffrey M. Gardner.

U.S. application No. 09/847,818, filed May 1, 2001, Jeffrey M. Gardner.

*Primary Examiner*—Gary E. Elkins
(74) *Attorney, Agent, or Firm*—Christensen O'Connor Johnson Kindness PLLC

(57) ABSTRACT

A container is described having inner and outer members. The inner member includes opposed side walls, a rear portion, and a front portion. At least one of the front and rear portions includes a pair of side flanges, each including a notch. The outer member has a bottom panel, side walls, a rear portion and a front portion. At least one of the front and rear portions includes a pair of upright wrapping panels and a bottom flange. As assembled, the inner member is positioned within the outer member so that the inner member side walls and the outer member side walls are adjacent one another. The inner member notches mate with the outer member bottom flange to form a coplanar combination. The upright wrapping panels are positioned exterior to the combination and overlap at least portions of both the side flanges and the bottom flange.

7 Claims, 5 Drawing Sheets

U.S. PATENT DOCUMENTS

| | | | | | |
|---|---|---|---|---|---|
| 4,333,600 | A | | 6/1982 | Gardner | |
| 4,376,507 | A | | 3/1983 | Nauheimer | |
| 4,398,901 | A | | 8/1983 | Campbell | |
| 4,581,005 | A | | 4/1986 | Moen | |
| 4,601,687 | A | | 7/1986 | Gallaher | |
| 4,657,527 | A | | 4/1987 | Moen | |
| 4,793,494 | A | | 12/1988 | Gordon, Jr. | |
| 4,850,948 | A | | 7/1989 | Schmitz | |
| 4,955,502 | A | | 9/1990 | Sorci | |
| 5,143,278 | A | | 9/1992 | Petriekis et al. | |
| 5,316,210 | A | | 5/1994 | Scullin | |
| 5,333,777 | A | | 8/1994 | Roth | |
| 5,335,844 | A | | 8/1994 | Young | |
| 5,419,485 | A | | 5/1995 | Petriekis et al. | |
| 5,520,325 | A | | 5/1996 | Quaintance | |
| 5,950,911 | A | * | 9/1999 | Naughton et al. | 229/164 |
| 5,950,915 | A | | 9/1999 | Moen | |
| 5,967,406 | A | | 10/1999 | Moorman | |
| 5,975,413 | A | | 11/1999 | Moen | |
| 6,027,017 | A | * | 2/2000 | Kuhn et al. | 229/164 |

* cited by examiner

CORRUGATED PAPERBOARD CONTAINER CROSS-REFERENCE TO RELATED APPLICATION

CROSS-REFERENCE TO RELATED APPLICATION

This application claims priority to U.S. Provisional Application No. 60/200,950 filed May 1, 2000, the priority benefit to which is hereby claimed under 35 U.S.C. § 119(e).

FIELD OF THE INVENTION

The present invention relates to corrugated paperboard containers for shipping and display, and more particularly, to Bliss-style containers having an inner liner and an outer body wrap configured to attain high strength while economizing on the amount of material.

BACKGROUND OF THE INVENTION

Various types of Bliss containers are known. In general, a Bliss container includes at least one inner portion (or liner) and an outer portion (also called a body wrap or tray) adhered about the inner portion. Bliss containers offer many advantages, most notably that they are stronger than most containers due to their having double-and triple-wall thicknesses. This makes Bliss containers particularly advantageous for shipping and display purposes. See for example, U.S. Pat. No. 5,950,915 in which an H-divider Bliss container is described.

Known Bliss containers are useful; however, they often require a merchandiser to manipulate the products within the container in order to effectively display them. Thus, a need exists for a high-strength, stackable, Bliss container in which such manipulation is not necessary but, rather, product is visible throughout the interior of the container even as product is removed and from either container side. The present invention is directed to fulfilling this need and others as described below.

SUMMARY OF THE INVENTION

The present invention is a container having inner and outer members. The inner member includes opposed side walls, a rear portion, and a front portion. At least one of the front and rear portions includes a pair of side flanges, each including a notch. The outer member has a bottom panel, side walls, a rear portion and a front portion. At least one of the front and rear portions includes a pair of upright wrapping panels and a bottom flange. As assembled, the inner member is positioned within the outer member so that the inner member side walls and the outer member side walls are adjacent one another. The inner member notches mate with the outer member bottom flange to form a coplanar combination. The upright wrapping panels are positioned exterior to the combination and overlap at least portions of both the inner member side flanges and the outer member bottom flange.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
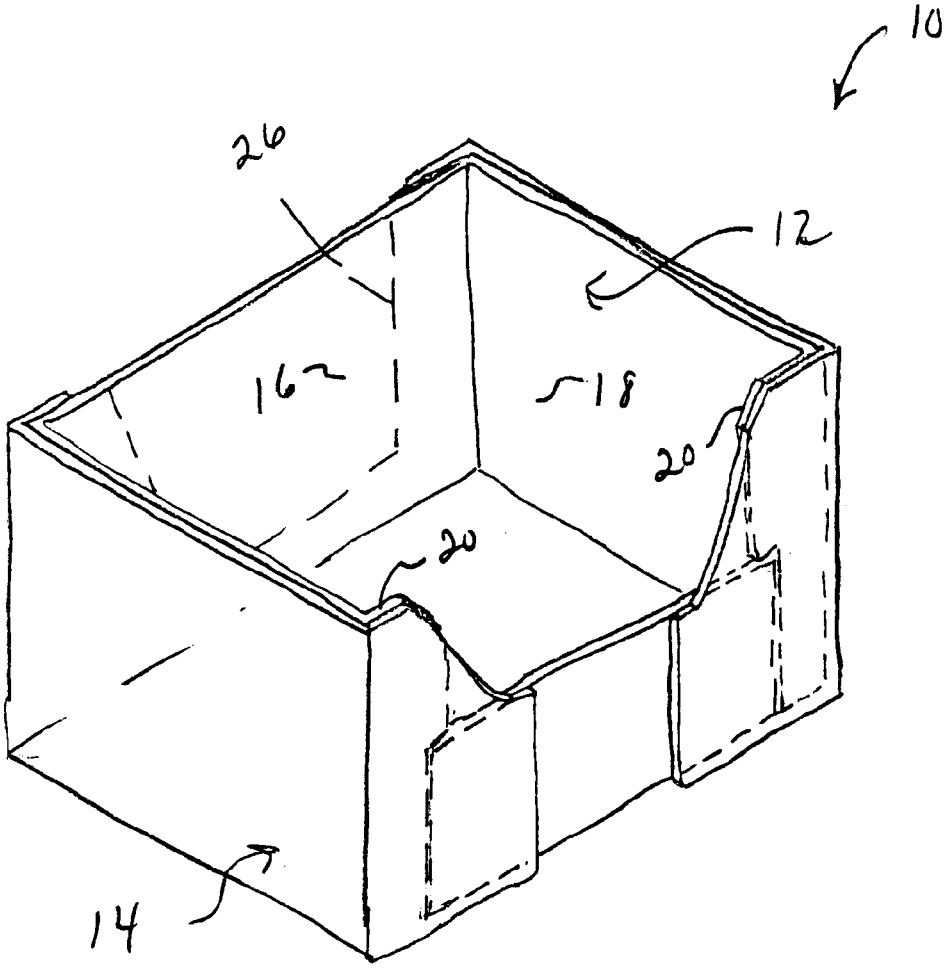
FIG. 1 is an orthogonal view of one embodiment of a container formed in accordance with the present invention.
Figure 2:
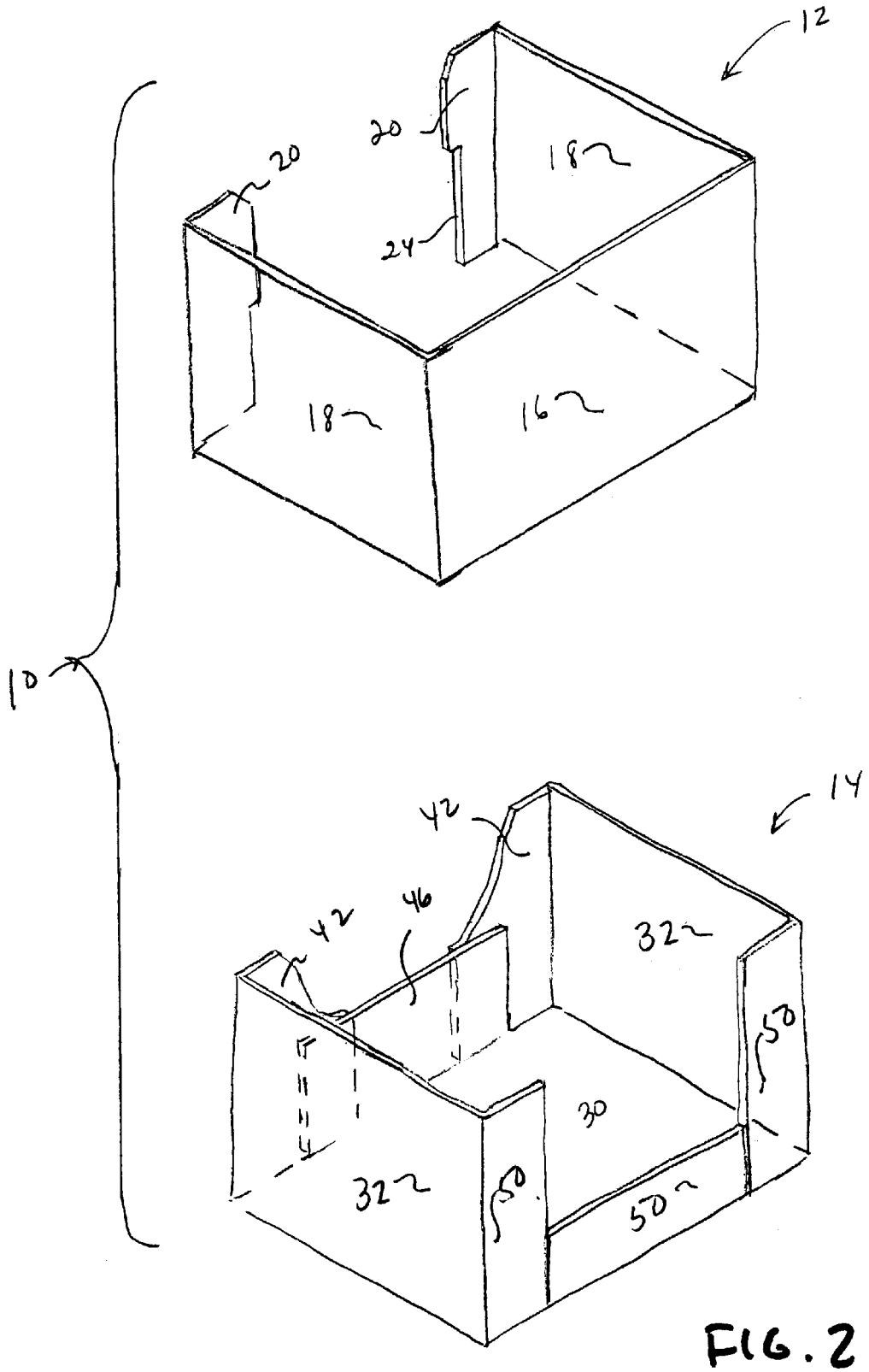
FIG. 2 is an exploded orthogonal view of the container of FIG. 1, taken from the opposite direction.
Figure 3:
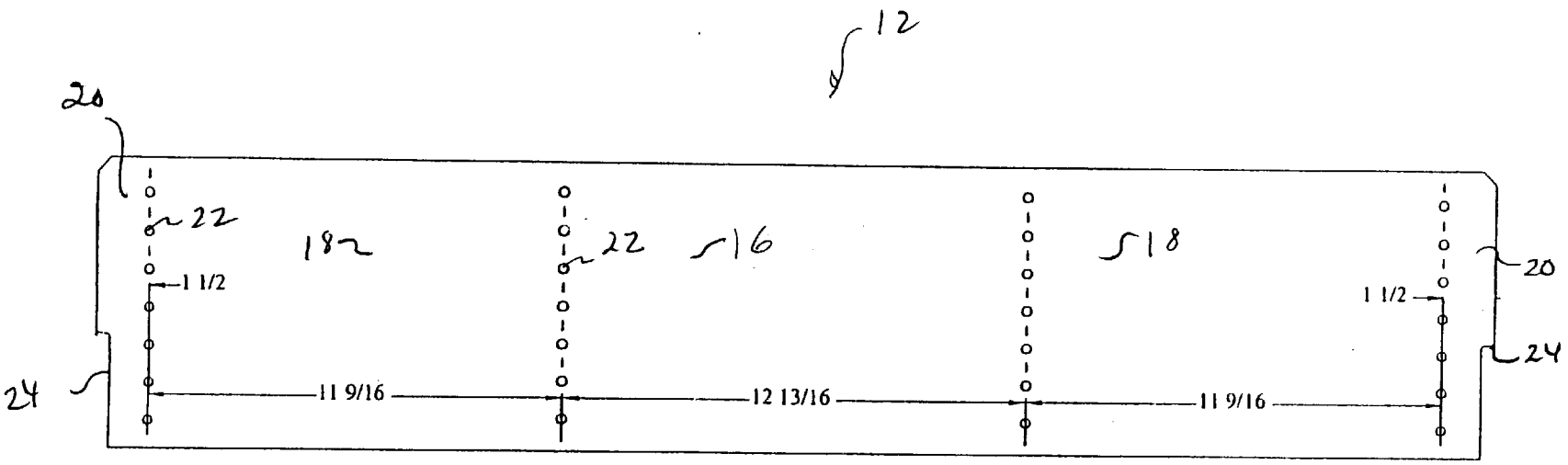
FIG. 3 is a plan view of an inner member blank used in the container of FIG. 1.
Figure 4:
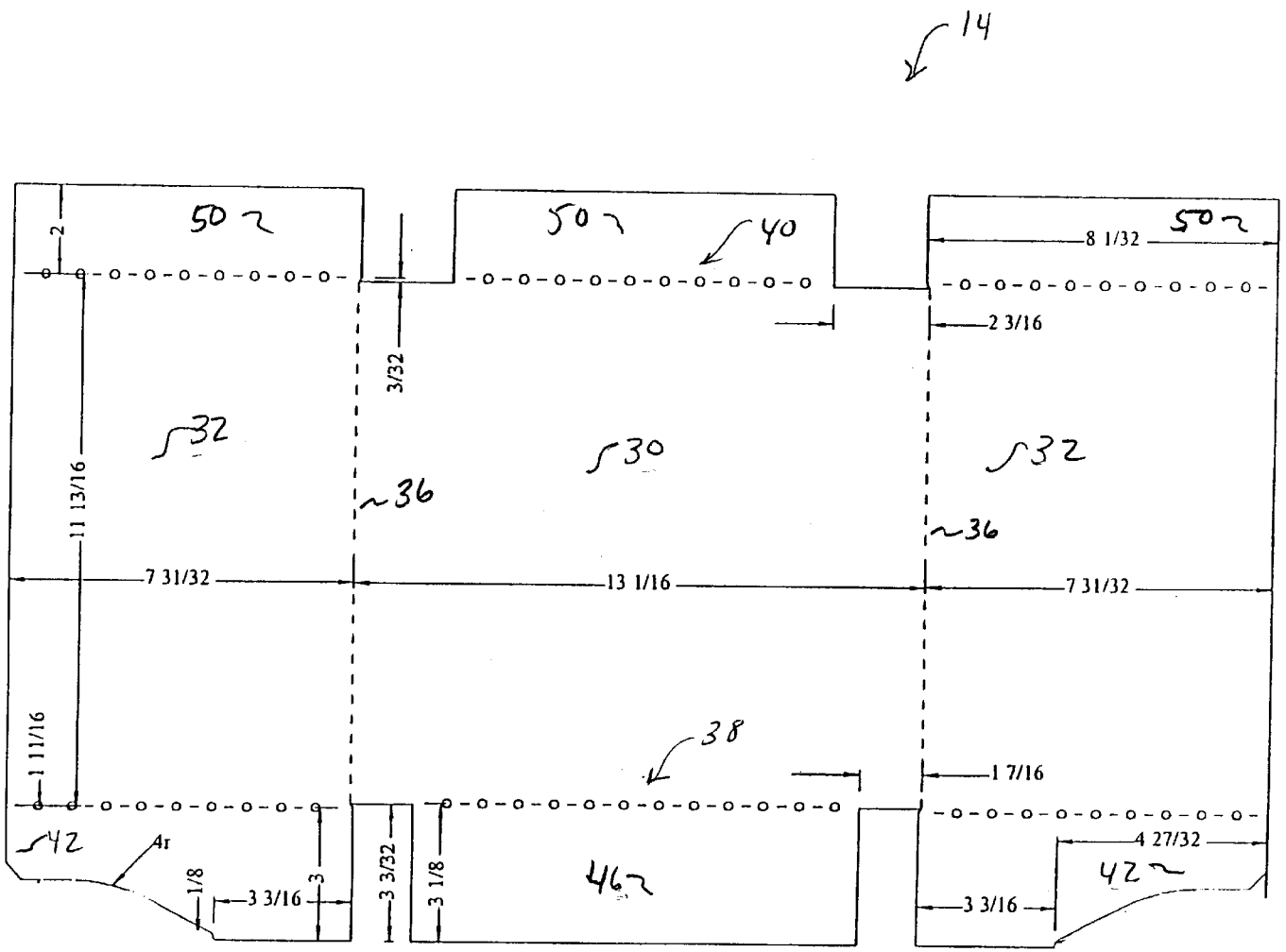
FIG. 4 is a plan view of an outer member blank used in the container of FIG. 1.

The present invention is a multipiece container 10 having excellent high compression strength yield. Referring to FIG. 1, the present invention is a Bliss container having an inner member 12 and an outer member 14. According to one embodiment of formation, the inner member 12 is formed and then the outer member 14 is formed about the inner member 12. This is described below with reference to FIG. 5. The outer member 14 is preferably adhered to the inner member 12 during formation of the outer member 14 so that the container 10 remains a unitary object throughout its use. The outer member 14 includes at least one side surface with a relatively large opening so that product within the container 10 can be easily viewed. FIG. 2 is an exploded view of the container 10 showing the relative placement of the inner and outer members 12, 14. FIGS. 3 and 4 are plan views of the inner member and outer member blanks.

As used herein, the terms "front", "rear", and "side" are provided as an aid to describing the relative location of the various components and are not meant to be limiting in any way. Thus, for example, depending on a particular application, the "front" may end up being the "rear" of the container or a "side", "top", or "bottom" during use or shipment.

Referring to FIG. 3, the inner member 12 is formed from a single-piece blank and includes a rear panel 16 and opposed side walls 18 hingedly connected in series to opposite rear panel side edges. A side flange 20 is hinged to the outer edge of each opposed side wall 18. The various panels are preferably hingedly connected via conventional score lines 22. Each side flange 20 includes a notch 24 located along the lower portion of its exterior edge. As shown in FIG. 1, an optional perforation 26, or opening, may be provided in the inner member rear panel 16 to permit viewing into the container 10 from the rear. When erected, the inner member 12 is C-shaped, with the side walls 18 forming the upper and lower arms, the rear panel 16 forming the connecting member, and the side flanges 20 forming the serifs.

Referring to FIG. 4, the outer member 14 is preferably formed from a single-piece blank having a bottom panel 30 and side walls 32 connected to opposed bottom panel side edges. These components are connected along conventional hinge lines 36. The outer member includes a front edge 38 and a rear edge 40. All upright wrapping panel 42 is connected to the front edge of each outer member side wall 32. A bottom flange 46 is connected to the front edge of the bottom panel 30. Both the upright wrapping panels 42 and the bottom flange 46 are of a width less than the overall width of the bottom panel 30 for reasons described below. In the embodiment shown. the rear portion of the outer member 14 includes support flanges 50 attached to the rear edges of the bottom panel 30 and the side walls 32.

As shown in FIG. 1. as assembled, the inner member 12 is positioned within the outer member 14. The outer member bottom panel 30 is oriented laterally. The outer member side walls 32 are upright from the bottom panel 30 and are adjacent the inner member side walls 18. The outer member support flanges 50 are also upright from the bottom panel 30 and are adjacent the inner member rear panel 16. See FIG. 2. The bottom flange 46 is upright from the bottom panel 30. The upright wrapping panels 42 are folded inward so that they are orthogonal to both the bottom panel 30 and their respective outer member side walls 32. The sizing of the outer member upright wrapping panels 42, and the inner member side flanges 20 is such that, as assembled, these panels are parallel, though not coplanar. Instead, the inner member side flanges 20 are coplanar with the outer member bottom flange 46. The side flange notches 24 mate with the bottom flange 46 to form the coplanar combination. The upright wrapping panels 42 are positioned exterior to the combination and overlap at least portions of both the side flanges 20 and the bottom flange 46.

Figure 5:
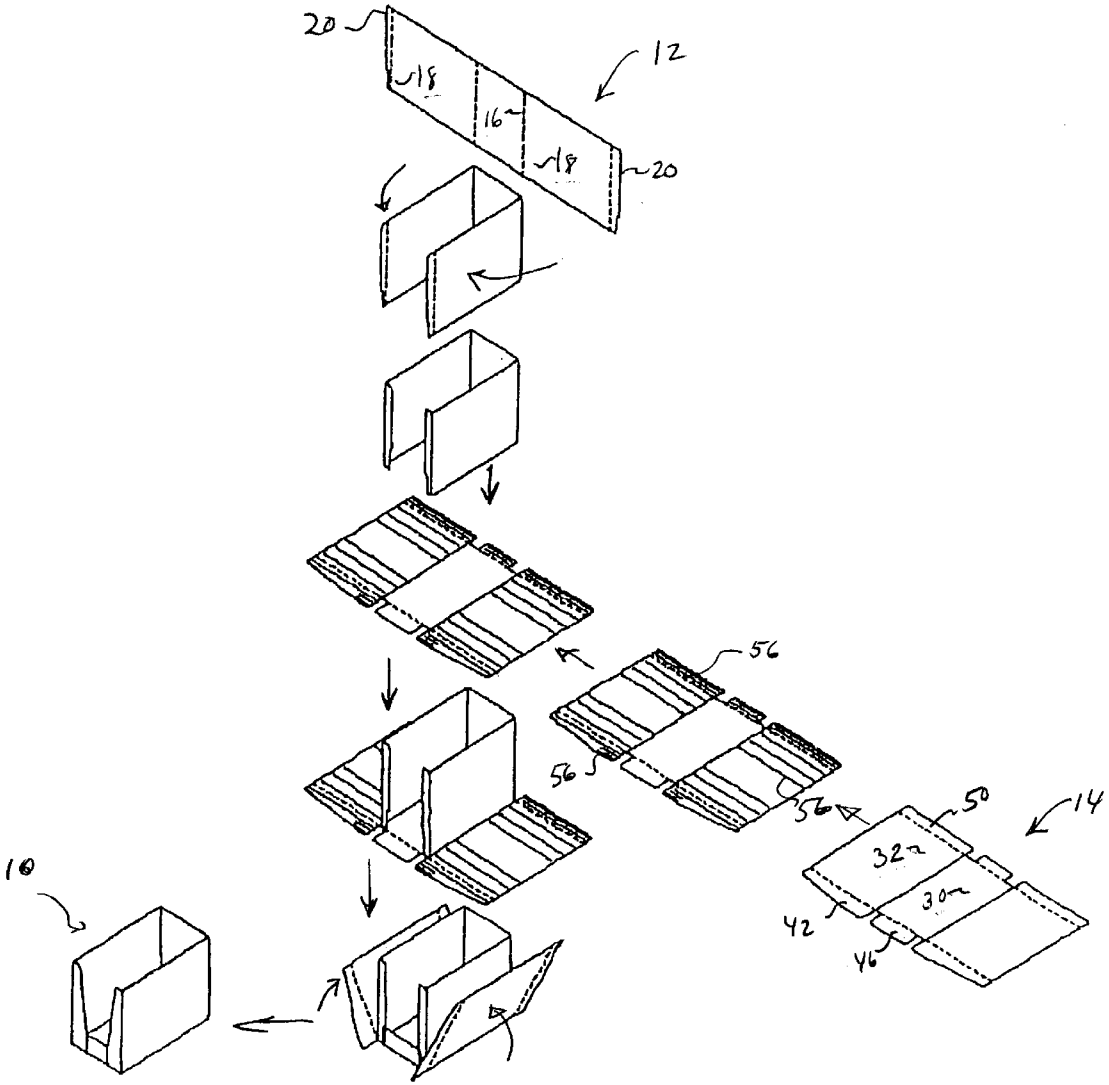
FIG. 5 is an orthogonal view showing a method of assembly for the container of FIG. 1.

FIG. 5 illustrates one embodiment of a method to machine form the container 10 described in FIGS. 1–4. The inner panel is folded into a C-shape by wrapping the inner member 12 about a die in a Bliss former machine. The outer member 14 is translated along a conveyor where adhesive 56 is placed on the interior surfaces of the outer member side walls 32, the three support flanges 50, and the upright wrapping panels 42. The C-shaped inner member 12 is positioned on the interior surface of the outer member bottom panel 30. The outer member bottom flange 46 is folded upright to mate in the notches 24 of the inner member side flanges 20. As mated the combination of bottom flange 42 and side flanges 20 form a coplanar wall. Next, the side walls 32 of the outer member 14 are folded upright and adhered to the exterior surface of the side walls 18 of the inner member 12. The three outer member support flanges 50 are folded inward to adhere to the exterior surface of the inner member rear panel 16.

In preferred embodiments, the inner and outer members are formed of corrugated cardboard material comprising a fluted medium. When the inner member and outer member are erected, their respective flutes are vertically oriented. In one embodiment, one or more of the various panels of the inner and outer members are double laminated to improve top to bottom container strength.

A number of variations relative to the above description are possible in the present invention container 10. For example, both the front and rear portions of the container may be made with the mating inner member side flanges and outer member upright wrapping panels. In such embodiments, the inner member is formed as two separate pieces. Another variation is in the attachment of the inner member to the outer member. It is possible to adhere only the upright wrapping panels 42 to the bottom flange 42 of the outer member, thereby eliminating an adhesion connection between the inner and outer side walls 18, 32 and between the upright wrapping panels 42 and the inner member side flanges 20. In doing so, the user is capable of completely removing the inner member, e.g., for display purposes. Further, various glue lines may be used to form the container. The placement of glue, in general, will vary depending on the particular application and the strength required.

As will be appreciated from a reading of the above, the container can be easily sized to hold products of various sizes and shapes, e.g., liter bottles or the like. In addition, the container may be formed with an overall dimension that allows for optimum pallet fit. This helps to reduce distribution and manufacturing costs. Further, the present invention container allows merchants to further use the box as a part of an in-store display with only minimum effort required on the merchant's part. If formed with rear and front openings, the present invention permits full viewing of the held product from either front or rear sides.

Numerous other benefits may be obtained with the present invention. Using laminated single-wall material, the present invention provides improved top to bottom compression strength, even holding up to 2000 lbs. The container may be shrink wrapped for closure as well. The present invention provides additional benefit in resistance to stretch film pressure and improved durability and performance throughout distribution. The exterior surface of these walls and panels may be smooth so as to accommodate graphic arts, such as advertising printings and stickers. Various shapes and sizes of cutouts and front panels may be used according to the requirements of a particular application. The present invention container eliminates the need for a merchandiser to rotate the container in order to display product remaining after the initial front products have been removed. Rather, product is visible throughout the interior of the container even as viewed from only one side.

While the preferred embodiment of the invention has been illustrated and described. It will be appreciated that various changes can be made therein without departing from the spirit and scope of the invention. For example, the present invention container may be formed with various top lids and/or flaps. A lid may be folded off of one of the panels of either the inner and/or outer members, or alternatively, the lid may be a separate component altogether.

The embodiments of the invention in which an exclusive property or privilege is claimed are defined as follows:

1. A container comprising:

(a) an inner member including opposed side walls, a rear portion, and a front portion; at least one of the front and rear portions including a pair of side flanges connected to edges of the opposed side walls; the side flanges each including a notch; and (b) an outer member having a bottom panel, side walls connected to opposed bottom panel side edges, a rear portion and a front portion; at least one of the front and rear portions including a pair of upright wrapping panels and a bottom flange; one upright wrapping panel being connected to each outer member side wall; the bottom flange being connected to an edge of the bottom panel;

wherein as assembled, the inner member is positioned within the outer member so that the inner member side walls and the outer member side walls are adjacent one another; the inner member notches mating with the outer member bottom flange to form a coplanar combination; the upright wrapping panels being positioned exterior to the combination and overlapping at least portions of both the side flanges and the bottom flange.

2. The container according to claim 1, wherein the upright wrapping panels are adhered to the side and bottom flanges.

3. The container according to claim 1, wherein only the inner member front portion includes a pair of side flanges and only the outer member front portion includes upright wrapping panels and a bottom flange.

4. The container according to claim 3, wherein the inner member rear portion includes a rear panel connected between the inner member side walls and the outer member rear portion includes at least one non-overlapping support flange adhered to the inner member rear panel.

5. The container according to claim 4, wherein the outer member rear portion includes three non-overlapping support flanges connected to rear edges of the outer member side walls and bottom panel, the three support flanges being adhered to the inner member rear panel as assembled.

6. The container according to claim 1, wherein only one of the front and rear portions of the inner and outer members includes a pair of side flanges and upright wrapping panels.

7. The container according to claim 6, wherein the portion of the container not having side flanges and upright wrapping panels includes a perforated portion that may be removed for viewing into the container.

* * * * *